US005116237A

United States Patent [19]

Loewen

[11] Patent Number: 5,116,237

[45] Date of Patent: May 26, 1992

[54] PRINTED CIRCUIT BOARD EDGE CONNECTOR

[75] Inventor: Heinz Loewen, Palos Verdes, Calif.

[73] Assignee: Versatile Engineering Co., Inc., Gardena, Calif.

[21] Appl. No.: 438,976

[22] Filed: Nov. 20, 1989

Related U.S. Application Data

[63] Continuation of Ser. No. 217,323, Jul. 11, 1988, abandoned, which is a continuation-in-part of Ser. No. 96,379, Sep. 14, 1987, abandoned.

[51] Int. Cl.[5] ..... H01R 13/62

[52] U.S. Cl. ..... 439/326; 439/885; 29/845; 29/884

[58] Field of Search ..... 439/325-328, 439/260-267, 59-62, 329, 883, 860, 885; 29/845, 884

[56] References Cited

U.S. PATENT DOCUMENTS

| | | | |
|---|---|---|---|
| 2,944,330 | 7/1960 | Swick | 439/883 |
| 3,609,640 | 9/1971 | Longnecker | 439/751 |
| 3,761,871 | 9/1973 | Teurlings | 439/751 |
| 3,858,163 | 12/1974 | Goodman et al. | 439/751 |
| 4,575,172 | 3/1986 | Walse et al. | 439/329 |
| 4,713,013 | 12/1987 | Renier et al. | 439/326 |

*Primary Examiner*—David L. Pirlot
*Attorney, Agent, or Firm*—Allan M. Shapiro

[57] ABSTRACT

The connector is for receiving the edge of a printed circuit board and making contact with the pads along the edge thereof. The connector has a body in which is positioned a plurality of longitudinally arranged U-shaped sockets which receive the edge of the board. Formed points are located in the sockets at a different distance from the bottom of the socket. These points are spaced so that the board may slide therebetween and then, as the board is turned in the socket, it engages the points to make assured contact.

23 Claims, 4 Drawing Sheets 10
12
14
16
18
20
22
24
28
30
32
34
36
38
42
44
50
52
112
114
116
118
120

FIG. 3
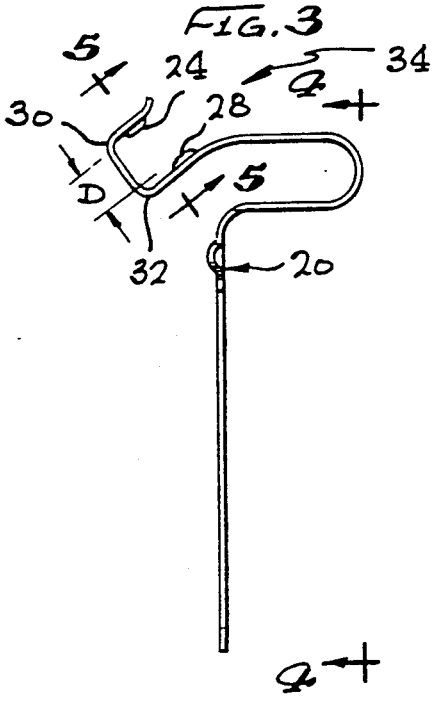
FIG. 4
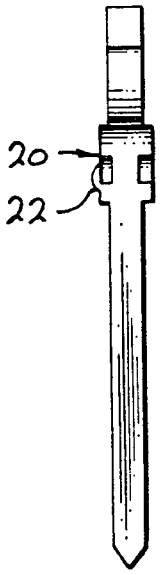
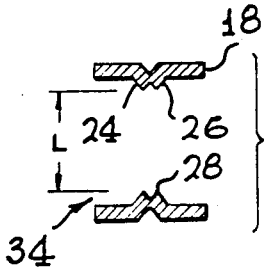
FIG. 5
FIG. 7
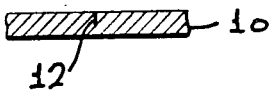
FIG. 6
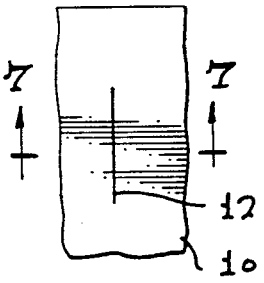
FIG. 8
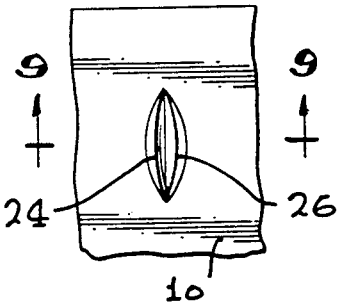
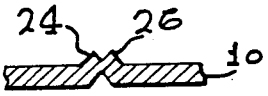
FIG 9
FIG. 16
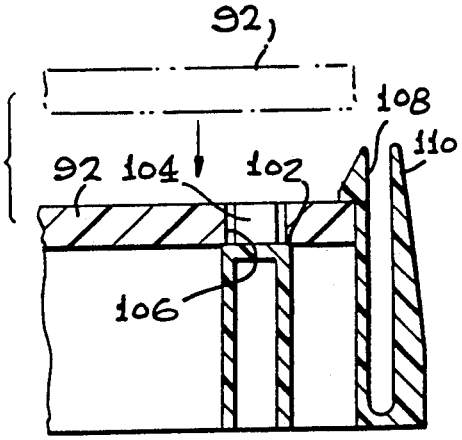
FIG. 15
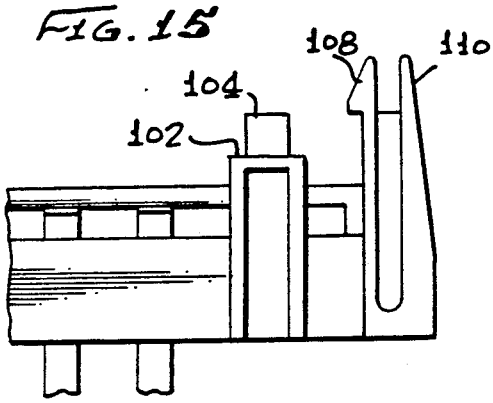

20
22
44
46
48
52
54
60
62
64
66
68
70
72
74
76
78
80
82
102
104
108
11
13

FIG. 14
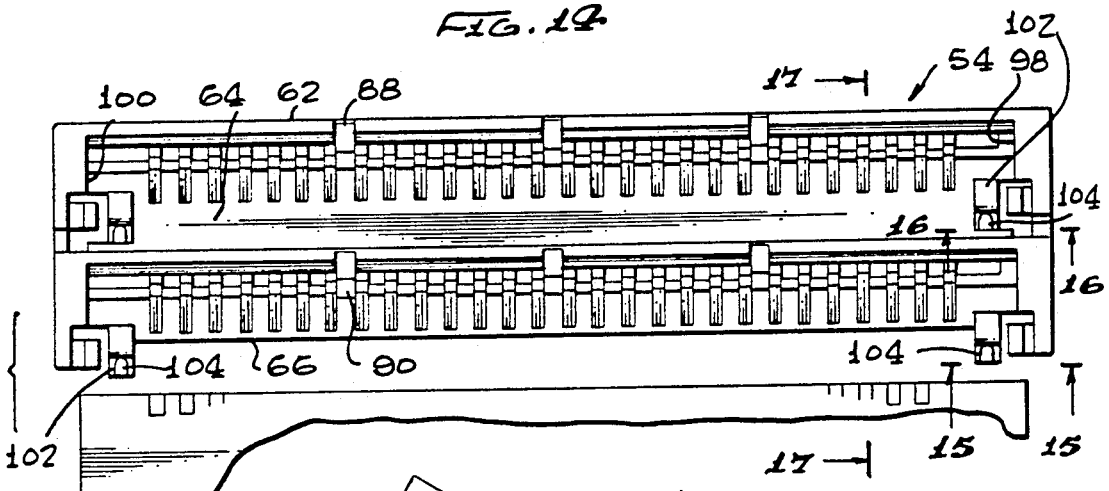
FIG. 17
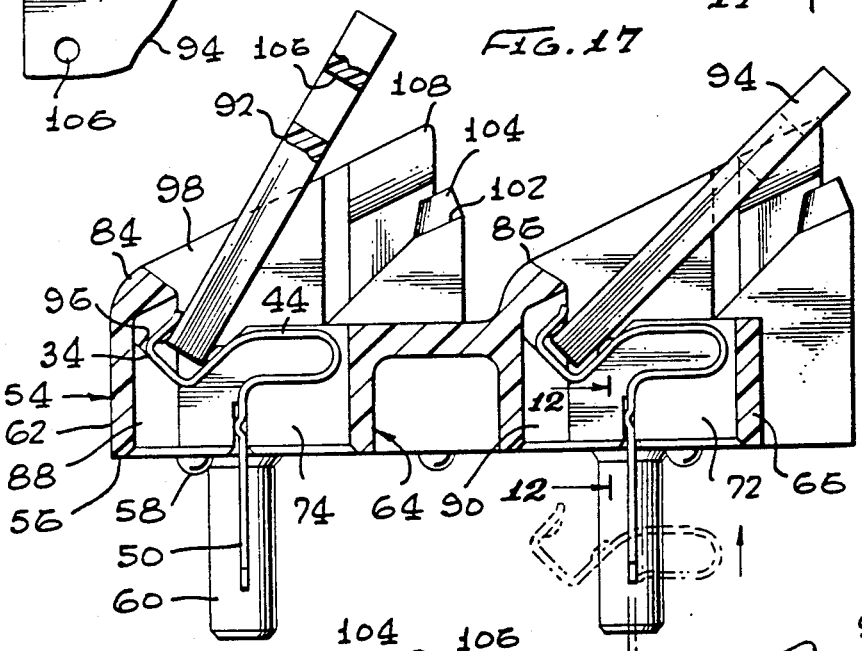
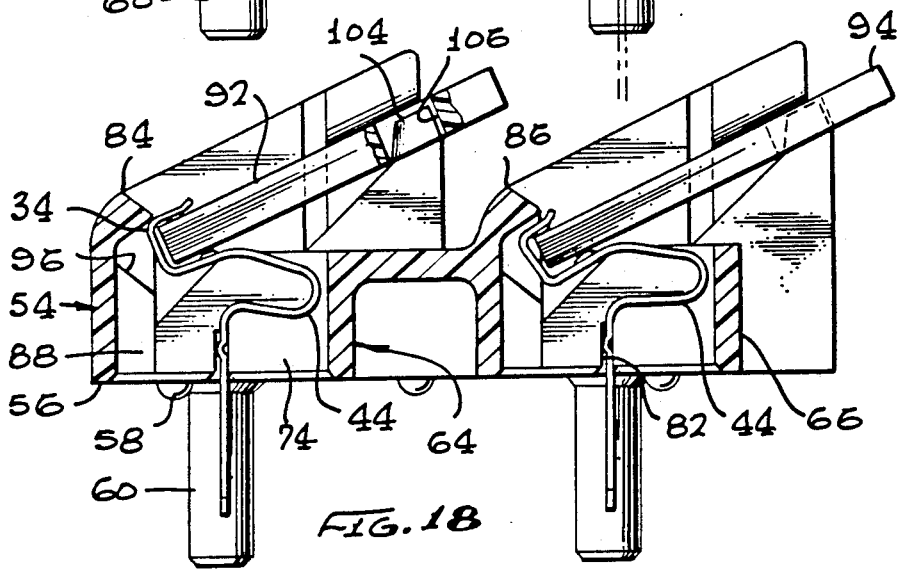
FIG. 18

PRINTED CIRCUIT BOARD EDGE CONNECTOR

CROSS REFERENCE

This application is a continuation of U.S. application Ser. No. 07/217/323 filed Jul. 11, 1988, now abandoned, which is a continuation-in-part of my prior application Ser. No. 96,379, filed Sep. 14, 1987 entitled "Edge Board Connector, Low Insertion Force, Loss Stress," now abandoned, the entire disclosure of which is incorporated herein by this reference.

FIELD OF THE INVENTION

This invention is directed to a printed circuit board edge connector where the connector can be mounted for further electrical connection and can receive printed circuit boards for making an electrical connection thereto.

BACKGROUND OF THE INVENTION

In the electronic arts, printed circuit boards or printed wiring boards are configured to receive many electronic components, such as integrated circuit chips which may have memory or logic functions. Large memory capability requires a large number of integrated circuit chips. In modern technology, the integrated circuit chip packages are surface-mounted upon a printed circuit board. The printed circuitry is led to pads adjacent the edge of the board where interconnection to other circuitry is required. In the past, such boards have been permanently interconnected with the mother board by being soldered directly thereto. Connectors have more recently been employed to permit ease of insertion and removal of such boards. There are many contacts, and each contact requires wiping on installation in order to achieve reliable connection. With a large number of contacts, an adequate wiping force at each contact soon becomes too high so that excessive forces are required to install the board. These excessive forces may cause bending of the board, and with surface-mounted components, such bending is undesirable as causing connection failures.

Another problem which arises is the fact that these printed circuit boards, which are dielectric synthetic polymer composition material, often filled with fiberglass or the like, have a considerable thickness tolerance in normal manufacture. Thus, the board thickness varies to make it more difficult to achieve reliable contact. A prior edge connector employs a C-shaped stamped contact which permits low insertion force, but when a printed circuit board at the thickest end of acceptable tolerance is employed therein, the contacts are bent beyond the elastic limits so that they do not return to the prior unstressed condition when the board is removed. This does not permit reliable reuse of the connector. In addition, because the C-shaped contacts are stamped out of flat stock, they have a very high spring coefficient. When there is adequate contact force with the thinnest printed circuit board, then the contact force is too high with the thickest board, resulting in distortions and difficult installation.

SUMMARY OF THE INVENTION

In order to aid in the understanding of this invention, it can be stated in essentially summary form that it is directed to a printed circuit board edge connector wherein the connector body carries a plurality of formed contacts, each of which has a socket with offset contact points therein. The socket receives the edge of the printed circuit board when the plane of the circuit board is normal to the direction between the contact points. The printed circuit board is then rotated and held in a position wherein the contact points engage pads on the board. Resilient deflection of the formed contacts, away from the socket, overcomes dimensional differences.

It is thus a purpose and advantage of this invention to provide a new, economical, highly reliable interconnection device for connecting to the edge of a printed circuit board to provide multiple contacts with pads on the printed circuit board when the printed circuit board is inserted into the connector and rotated and held in position.

It is another object and advantage of this invention to provide a circuitboard edge connector which is substantially zero insertion force and requires only a small amount of force to swing the circuit board into the contacted position where the circuitboard is held.

It is another object and advantage of this invention to provide a contact spring for such a printed circuit board which provides a U-shaped socket to receive the edge of the board and a single beam spring extends from the socket to the contact mounting so that resiliency due to different component sizes is taken up away from the socket.

It is another object and advantage of this invention to provide a formed contact structure which is located and held in the dielectric connector body in such a way as to provide accurate contact locations and accurate tail locations to permit accurate connection of the circuit boards into the connector and provide accurate location of the connector in the mother board.

It is another object and advantage of this invention to provide a connector wherein the contacts are stamped and formed from sheet metal in an orientation which will allow loading of multiple of such contacts into the connector body to assemble the connector without a large number of contact insertion operations.

It is another object and advantage of this invention to provide a connector body which contains and retains the contacts, which protects the contacts and which is drainable so that subsequent cleaning operations can be performed.

It is a further object and advantage of this invention to provide contacts by forming spring sheet metal so that the finished contacts are of low spring constant and operate within the elastic limit during the insertion and contact with printed circuit boards of normal thickness tolerance range.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 3 is an enlarged side-elevational view thereof.

FIG. 4 is a front elevational view thereof as seen generally along line 4—4 of FIG. 3.

FIG. 5 is an enlarged section through the contact points, as seen generally along line 5—5 of FIG. 3.

FIG. 6 is an enlarged plan view of the metallic sheet, as generally seen at 6 in FIG. 1, showing the creation of a slit in the sheet.

FIG. 7 is a section through the sheet, as seen generally along 7—7 of FIG. 6.

FIG. 8 is an enlarged plan view of a portion of the sheet, as seen at 8 in FIG. 1, showing the sharp contact point.

FIG. 9 is a section through the contact point, as seen generally along line 9—9 of FIG. 8.

FIG. 14 is a plan view of the complete printed circuitboard edge connector of this invention and showing a printed circuitboard positioned for insertion therein.

FIG. 15 is an enlarged rear elevational view, as seen generally along line 15—15 of FIG. 14, with parts broken away.

FIG. 16 is an enlarged section through the completed connector, as seen generally along line 16—16 of FIG. 14.

FIG. 17 is an enlarged transverse section through the connector, as seen generally along line 17—17 of FIG. 14, showing two printed circuitboards, of maximum and minimum thickness, inserted in the connector sockets.

FIG. 18 is a view similar to FIG. 17 showing the printed circuitboards rotated to latched position where they are in connection relationship to the connector.

DESCRIPTION OF THE PREFERRED EMBODIMENTS

Figures 1, 2, 19, 20:
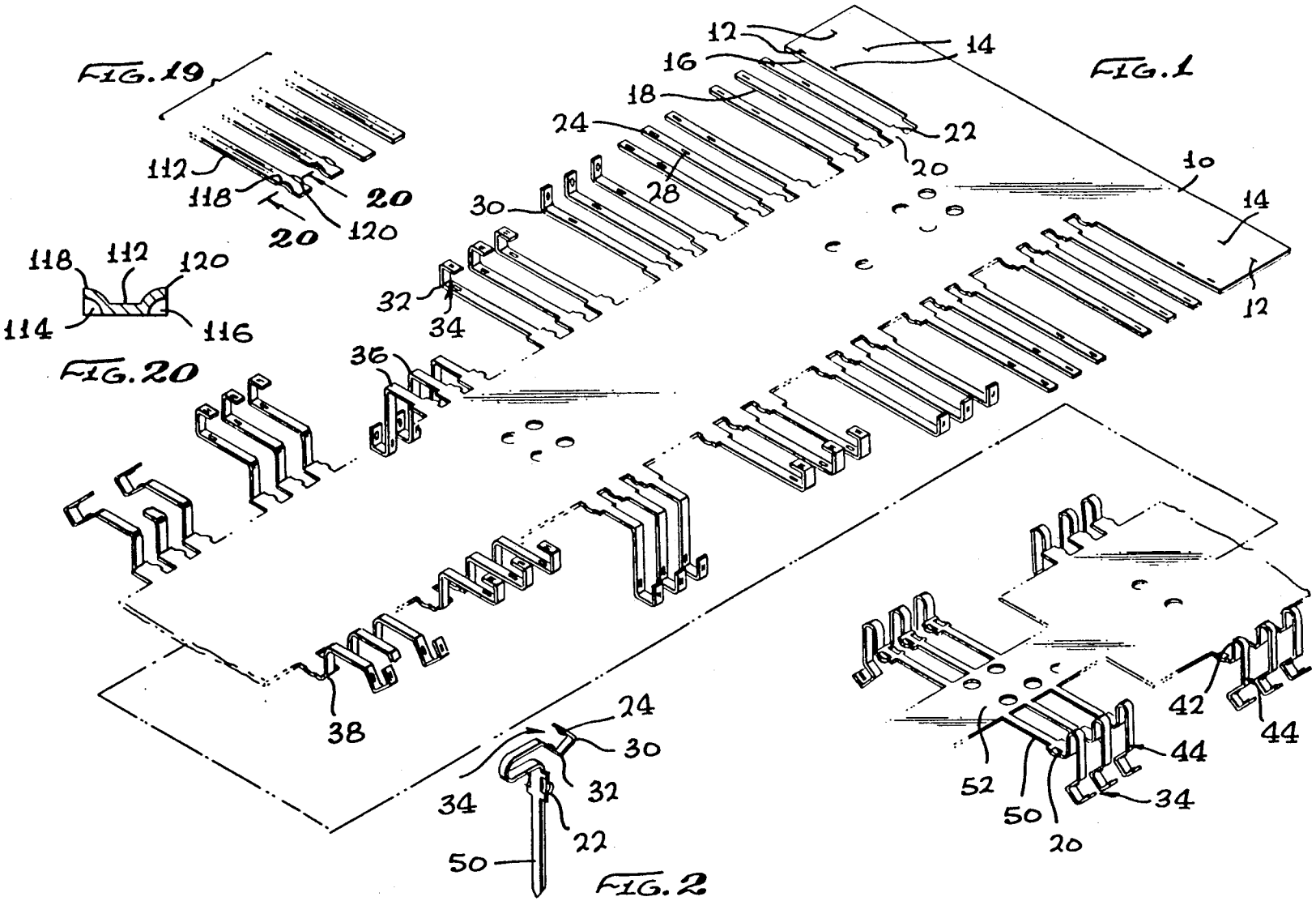
FIG. 1 is an isometric view of a sheet of contact spring metal as it is progressively fed through dies to form contact springs, with parts broken away.
FIG. 2 is an isometric view of a single completed contact.
FIG. 19 is an isometric view of a portion of the sheet of spring material as it is progressively fed through the dies, for the creation of a second preferred embodiment of the contact points.
FIG. 20 is an enlarged section taken generally along line 20—20 of FIG. 19 showing the configuration of the second preferred embodiment of the contact point.

FIGS. 1, 2, 3, 4, 5, 6, 7, 8, and 9 show the progressive forming of the contacts and the finished contacts. In FIG. 1, sheet material 10 is fed to a press where successive operations form the contacts. When the press operations are done, the contacts are still joined as a comb. The contacts are stamped and formed from any suitable conductive metallic spring alloy, and in the preferred embodiment, in the size disclosed herein, metallic spring alloy material approximately 0.010 inch thick is suitable. The progressive stamping and forming illustrated in FIG. 1 is illustrative of forming two combs of contacts at the same time. One may be formed. Since the combs of contacts are identical, the ones illustrated at the far edge of the metallic spring alloy sheet 10 will be described in detail. As a first step, slits 12 and 14 are formed. These slits are in line with each other and define the center line of the contact which is being formed. The slits may be made by means of a dyke, chisel or other slitter. Slot 16 is next stamped from the sheet to leave arm 18, which is of uniform width as it extends out of the wider attachment body 20 which has attachment tabs extending outward widthwise from the arm 18. Also remaining is guide bump 22 on the side of the attachment body.

The slitting is shown in large detail in FIGS. 6 and 7, and subsequent to the stamping out of the slot 16 to form the arm 18, the contact points are raised by coining from below. A top view of contact points 24 and 26 is seen in FIGS. 8 and 9 as a result of an upward application of the punch which separates and raises slit 12. Two pairs of contact points are formed on each arm, as seen in FIG. 1. In FIG. 1, only contact point 24 is indicated because of the smallness of this feature, but its companion contact point 26 lies next to it. Furthermore, another pair of contact points is similarly formed along the arm with its pair of contact points indicated at 28 in FIG. 1. It is to be noted that these pairs of contact points are spaced lengthwise from each other along the arm 18. Next, the arm is formed to define a socket. Bend 30 is first made, and bend 32 is next made to form a socket, generally indicated at 34. The socket is shown in more detail in FIGS. 2, 3 and 17. As seen in FIG. 3, the two portions of the arm which form the socket 34 lie substantially parallel to each other, and the contact points 24 and 28 are in opposite sides of the socket within the socket. It is important to note that these contacts are staggered, and they are a distance D from each other in the maximum straight-line distance therebetween. Furthermore, this straight-line distance is at an angle to the arms of the U-shaped socket 34. The distance between the contact points in a direction normal to the arms of the socket is a distance L. FIG. 5 shows a section through the socket 34 in a direction normal to the direction of the arms. A detail of the socket is shown in FIG. 5 where the cross-section is taken at right angles to the arms of the socket to show the dimension L.

This completes the formation of the socket, and next the spring is formed in the arm between the socket and the attachment body 20. Bends 36, 38, 40 and 42 are successively made to provide the desired spring shape between the socket and its mounting at attachment body 20. It is understood that the spring shape is a function of the manner in which the socket is going to lie in the connector body. As will be seen later, the printed circuitboard will lie in the connector body at an acute angle with respect to the bottom of the connector, in the preferred embodiment disclosed. In other embodiments, the printed circuitboard may lie at other angles, such as normal to the bottom of the connector, and in such cases the shape of the spring will orient the direction of the socket. The size of the drawing sheet prevents the showing of these successive bends along the length of travel of the metallic spring sheet 10 through the die. However, it is understood that the production is preferably unidirectional and continuous through the die. In the upper part of FIG. 1, three contacts are being shown as formed in each operation, and in the lower part of FIG. 1, two contacts are shown as being formed in each operation. In a suitable progressive die, one or more contacts may be operated upon at each die station. With the completion of bending, the spring is formed between the socket and the attachment body.

Figures 10, 11, 12, 13:
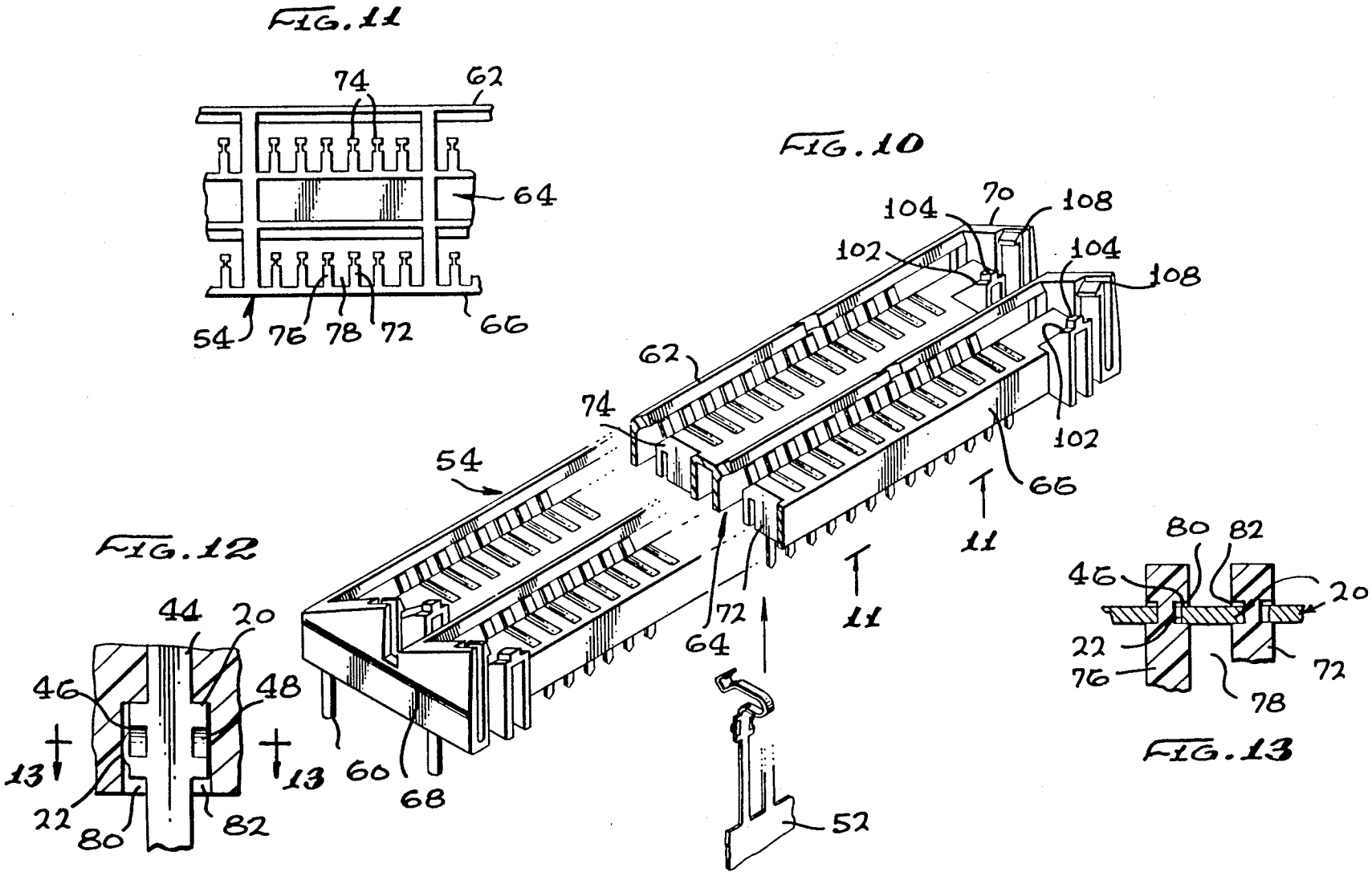
FIG. 10 is an isometric view of the connector body without the contacts installed therein.
FIG. 11 is a bottom view of the connector, as seen generally along line 11—11 of FIG. 10.
FIG. 12 is a section through the connector body at one of the slots holding one of the contacts, as seen generally along line 12—12 of FIG. 17.
FIG. 13 is a section, as seen generally along line 13—13 of FIG. 12.

After bending of the spring portion is complete or as part of the spring-bending operation, dimples are coined into the attachment body. It is important to note that the attachment body is wider than the spring section 44. The wider width is shown in FIG. 12, which also shows the presence of the guide bump 22 on the attachment body and the presence of two coined dimples 46 and 48. The dimples are coined in the same direction as the socket. The final step in preparation of the comb is the further stamping of the flat portion of the metallic spring alloy sheet 10 to create pins 50 below the attachment body 20. The pins 50 need not be more narrow than the attachment body, but for other purposes are considerably narrower than the attachment body. The pins are still attached to the comb back 52, as is seen at the bottom of FIG. 1 and at the bottom of FIG. 10. A group of the contacts is handled together, including insertion in the connector body. During the forming of the pins, a breakoff line is partly cut through at the juncture between the pins 50 and the comb back 52. A plurality of contacts on a comb back is a comb which may have as many contacts thereon as there are pockets in the connector body, or several comb-carried sets of contacts may need to be employed to fill all the pockets in the connector body.

Connector body 54 is shown in isometric view in FIG. 10, in bottom view in FIG. 11, in plan view in FIG. 14, and in enlarged transverse section in FIGS. 17 and 18. The connector body 54 is illustrated as being configured to receive two printed circuitboards for edge connection, but it may be configured to receive one or more than two circuitboards for edge connection. The connector body is configured as a rectangular structure having a flat bottom 56 on which feet 58 are mounted in order to space the body above the mother printed circuitboard upon which the connector is mounted. Pins 60 also extend from the bottom to permit location of the connector body on the mother printed circuitboard at a precise location. The pins 60 may be of different sizes or may be non-symmetrically located so that the edge connector body is mounted on the mother printed circuitboard only in one orientation. That location and orientation is determined by the tooling holes in the mother printed circuitboard which receive the pins. The contact pins extend downward out of the body of lesser distance than the pins 60 so that, when the connector is placed on the mother printed circuitboard, it is properly positioned thereon by the pins 60. Then the pins 60 and contact pins all drop through their holes at one time. The spacing of the connector body above the printed circuitboard permits cleaning of all surfaces.

The body is made up of front rail 62, center rail 64 in the shape of a downwardly-directed channel member, and rear rail 66. The rails are connected at their ends by left-end panel 68 and right-end panel 70. As seen in FIGS. 17 and 18, this structure defines two longitudinal channels down the length of the connector body. Webs extend forward into the channels. Web 72 is shown in the right channel, and web 74 is shown in the left one in FIGS. 17 and 18. These webs are a series of webs, as seen in FIGS. 10, 11 and 14, which define pockets therebetween. The webs 72 and 74 are illustrated in FIG. 10 as being the ones at the end of the brokenaway section, and the webs 72 and 74 are also illustrated in FIG. 11. The web 76 is also illustrated in FIG. 11 to define pocket 78. That portion of FIG. 11 is shown enlarged in FIG. 13. Slots 80 and 82 are formed in webs 76 and 72 and face each other. The slots are sized to receive attachment body 20. Pocket 78 is sufficiently wide to pass therethrough the socket and its spring. When the comb is inserted into the connector body from the bottom, as indicated in FIG. 10, each socket and its spring is inserted upwardly through its corresponding pocket, and then the attachment body enters into the facing slots at the sides of the pocket. Dimples 46 and 48 on the attachment body force the attachment body back into the slot and guide bump 22 presses the attachment body to the side of its slot. Thus, each contact engages one slot side and against the backs of both slots to provide exact reference of the contact with respect to its pocket. The full insertion is seen in FIGS. 17 and 18. After insertion, each of the contacts is individually retained in place by engagement of its attachment body in the side slots, and the comb back is broken off so that each contact is electrically isolated. The body is molded of dielectric synthetic polymer composition material to provide both electrical isolation and mechanical integrity. When in this position, the sockets are protected by ribs 84 and 86 on the rails. The pins extend downwardly with precise reference to the locating pins 60 so that the entire connector body may be inserted upon a mother board, with the contact pins extending therethrough so that wave soldering can electrically connect the pins to printed circuits on the mother board. Subsequent to such soldering, the assembly can be cleaned. In order to provide strength between the rails and a particularly long connector body, webs can extend all the way across between the rails. For example, in FIG. 11, web 88 extends between the front and center rails and web 90 extends between the center and the rear rails. This is for strengthening.

In FIG. 17, printed circuitboards 92 and 94 are shown as being inserted into the sockets of the contacts. Web 88 is cut down to edge 96, which provides an insertion limit for the printed circuitboard 92 to prevent overstressing of the spring 44 behind the socket 34. The upper rolled edge of rib 84 prevents damage from stroking across the socket. One of the problems in edge connection of printed circuitboards is that the board thickness tolerance of boards 92 and 94 is fairly wide. Normal board thickness tolerance, including the tinned contact pads on the edge thereof, ranges from 0.047 inch to 0.056 inch. The board 92 is illustrated as being the thicker board, and board 94 is illustrated as being the thinner board. These boards represent the outer limits of thickness tolerance. In order to permit zero insertion force of the board into the contact sockets, the socket is formed with a dimension D of 0.056 or slightly more to permit the free entry of the thicker board 92 at an angle normal to the direction D, as illustrated on the left side of FIG. 17. Furthermore, the socket is configured so that the distance L, between the contact points parallel to the sides of the socket, is 0.047 inch, which is the thickness of the board at the thinner edge of the tolerance. This permits the entry of thinner board 94 with zero contact pressure at any angle above that parallel to the arms of the socket 34. In both cases, the angle at which the board is inserted is above the position when the board is locked in place. As the board is rotated to the right from the insertion position shown in FIG. 17 to the connection position shown in FIG. 18, the sharp contact points cut into the tinned pans on the printed circuitboards. No wiping is necessary because the sharp contact points cut into the pads for reliable electrical contact.

The endwise position of the board with respect to the connector body is controlled by the inner walls of the end panels. For example, printed circuitboard 92 engages against right end wall 98 during its insertion so that the position along the length of the connector in the circuitboard is established. The circuitboard is a fairly close fit between the right end wall 90 and left end wall 100 shown in FIG. 14. In addition, stop surface 102 limits the rotation of the printed circuitboard to the right. At the same time, post 104 engages in tooling hole 106 in the printed circuitboard to precisely locate the printed circuitboard with respect to the connector body and thus with respect to the contacts therein. As seen in FIG. 17, the post 104 is tapered in order to adjust the printed circuitboard into precise position as it swings into place. The board is latched in place by means of latch 108. The latch 108 is shown in FIGS. 15, 16 and 17 is sized to engage over the top of the thickest board when the thickest board is brought down to the stop surface 102. The latch 108 is in the form of a hook with a tapered top surface so that, when the board is swung down into position, the latch is pushed aside and automatically snaps over the board by virtue of the resiliency of the material of which the latch is formed. In order to prevent the over-stressing of the latch and consequent possibility of breaking off the latch, latch stop 110 is provided, see FIGS. 15 and 16. The latch can swing away from latched position only a limited amount before it engages the latch stop to thus prevent over-stressing of the latch material. The latch is preferably integrally molded with the rest of the body. As seen in FIG. 10, there is a post at each end of each of the two printed circuitboard installation positions, and there is also a latch at each end thereof so that the printed circuitboard is precisely located in the connector and securely retained therein. In this manner, a printed circuitboard edge connector is formed which can have its body accurately molded of dielectric synthetic polymer composition material and have combs of contacts inserted therein so that automatic assembly is easily achieved. In addition, with reliable zero insertion force of the printed circuitboard together with reliable location of the circuitboard with respect to the contact points and reliable cutting of the contact points into the circuit pads on the board, automatic insertion of the printed circuitboards into the connector can also be achieved.

The contact is made up of a contact socket with contact points therein, a spring, attachment tabs and a pin, all integrally formed. The socket is designed to receive printed circuitboards of acceptable tolerance range, and it is not the socket which adjusts to the difference in board thickness. The socket is not deformed at all for different board thicknesses because the difference in thickness is taken up by the spring section of the contact. FIG. 18 shows the installed position of the board and shows the manner in which the spring sections deflect. Since deflection is in the thin direction of the contact, a low spring coefficient results so that the difference in contact force between the thin board and the thick board is acceptable and is fully within the elastic limit of the contact. Thus, the integrally formed contact with its separately functioning socket, spring, attachment body and pin each has a cooperative relationship to the whole contact and the connector body so that a reliable connector is achieved.

The features of reliability include the U-shaped socket, which does not need to bend to accommodate boards of different thicknesses and which has contact points therein which cut through the oxide layer on the tinned contact pads for reliable electrical connection. The preferred formation of the contact points is illustrated in FIGS. 5 through 9, but other springforming methods could also create sharp contacts. FIG. 19 shows the end of a spring contact arm 112, which is the equivalent of spring contact arm 18. In the case of contact arm 112, the edges of the arm are formed upwardly by means of dimples 114 and 116. As seen in FIG. 20, the dimples are at the edge of the contact arm. Raising of the dimples produces sharp contact points 118 and 120, which are the equivalent of the sharp contact points 24 and 26. In view of the width of the contact pads on the printed circuitboard and in view of the lateral stability of the entire contact when it is inserted in the connector body, the greater width across the points 118 and 120 is not needed for stability. Thus, the contact points created in the manner shown in FIGS. 19 and 20 are equivalent.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A contact:

said contact being cut out of the flat of a sheet of substantially planar metallic spring material and bent out of the plane of the sheet;

said contact having first and second arms having ends attached together and outer ends away from said attached ends to define a generally U-shaped socket therein, said first and second arms having first and second facing walls defining said socket, first and second contact points respectively in said first and second walls and generally facing each other, said contact points being spaced so that a printed circuitboard can be placed therebetween without contacting said points when it is at a first angle with respect to said walls and is in engagement with both said first and second points when the printed circuitboard is at a second angle with respect to said walls;

a formed spring extending from the outer end of one of said arms;

an attachment body on said spring away from said socket so that said attachment body can be secured to a connector body so that said spring can flex so that said U-shaped socket can move with respect to said attachment body as the printed circuitboard is moved from a first position at the first angle to a second position at the second angle; and a pin secured to said attachment body so that said pin can be connected to a mother board so that a printed circuitboard in said socket in said second position is connected to said contact and to the mother board.

2. The contact of claim 1 wherein a plurality of said contacts are attached to a comb back so that said plurality of contacts can be handled together for insertion into a connector body.

3. The contact of claim 1 wherein said contact points are formed as sharp points formed in said first and second walls.

4. The contact of claim 3 wherein at least one of said first and second walls is substantially flat and said first and second contacts are positioned so that a line therebetween is not normal to said flat wall.

5. The contact of claim 1 wherein said attachment body is wider than said socket and wider than said spring.

6. The contact of claim 5 wherein the connector body has a slot therein and said attachment body has a projection on the edge thereof, at least as wise as the slot in the connector body to thrust said attachment body towards one end of the slot.

7. The contact of claim 6 wherein a plurality of said contacts is attached to a comb back so that said plurality of contacts can be handled together for insertion into a connector body.

8. The contact of claim 5 wherein said attachment body has first and second formed dimples adjacent the edges thereof, wider than said spring so that, when placed in attachment slots in a connector body, said contact is thrust towards one side of the slots.

9. The contact of claim 8 wherein said attachment body has a projection on the edge thereof, at least as wise as the slots in the connector body to thrust said attachment body towards one end of the slots.

10. A connector comprising:

a body, said body having at least first and second rails defining the length thereof;

webs attached to one of said rails and extending transversely to said body to define upright pockets in said body, slots in said web, said slots extending partway through the thickness of said webs and extending partway through the height of said webs from the bottom of said body;

a contact within each of said pockets, each of said contacts being unitarily formed out of the flat surface of a sheet of spring metallic contact stock, each of said contacts having a pin and having an attachment body above said pin, said attachment body being wider than said pocket and being secured in said attachment slots in the sides of said pocket, a spring extending above said attachment body and a socket formed on said spring, said spring and said socket being narrower than the width of said body so that said spring and said socket can be inserted into said pocket from the bottom of said body, said socket being U-shaped and said spring extending from the end of one of the arms of said U-shaped socket, said sockets of each of said contacts being aligned along the length of said connector so that the edge of a printed circuitboard can be inserted therein for electrical connection thereto.

11. The connector of claim 10 wherein at least some of said webs extend between said first rail and said second rail and said webs extending between said first rail and said second rail have therein a notch defined by an edge, said edge being positioned so that insertion of a printed circuitboard into said socket and against said edge limits bending of said spring to resilient bending to inhibit permanent bending of said contacts.

12. The connector of claim 10 wherein first and second contact points are formed in said socket, generally directed towards each other, said contact points being spaced so that, when the printed circuitboard is inserted into said socket at a first angle, the edge of the printed circuitboard fits between said contact points, and when the printed circuitboard is moved to a second angle, said points cut into the surface of the printed circuitboard.

13. The connector of claim 12 wherein there is a locating post on said connector body positioned to be engaged by a tooling hole in the printed circuitboard so that when the printed circuitboard is moved to the second position, the tooling hole engages upon said locating post.

14. The connector of claim 12 wherein there is means for holding the printed circuitboard in the second position, said means comprising a latch engaging over the edge of the printed circuitboard, a latch stop formed on said connector body adjacent said latch to limit latch motion to inhibit latch breakage.

15. The connector of claim 14 wherein dimples are formed on said attachment body to thrust said attachment body to one side of said slots in which it is engaged.

16. The connector of claim 15 wherein a projection is formed on the edge of said attachment body to thrust said attachment body into one of its notches.

17. The connector of claim 10 wherein locating posts are formed on the bottom of said body, said locating posts extending farther below said body than said pins on said connectors.

18. The connector of claim 17 wherein feet are formed on the bottom of said body to hold the bottom of said body above a mother board on which said connector is mounted.

19. An electrical connector comprising:

a connector body;

a plurality of spaced spring contacts fixedly mounted in said body, each of said contacts being formed from a substantially flat sheet of metallic spring stock, each of said contacts including two opposing contact faces at the end of a single continuous length of spring, an attachment body on the other end of said spring, said attachment body being positioned within slots in said connector body, a pin on each attachment body to extend below said connector body for attachment into a mother circuitboard, first and second contact points within said socket, said contact points being spaced so that, upon entry of the edge of a printed circuitboard into said sockets at a first angle, no contact force is encountered and, upon rotation of the printed circuitboard to a second position, said contact points cut into pads on the circuitboard to ensure electric contact therewith; and first and second latches integrally formed with said body positioned to latch the printed circuitboard in the second position and first and second latch stops respectively positioned behind said first and second latches to inhibit excess motion of said latches to inhibit breakoff of said latches.

20. An electrical connector comprising:

a connector body;

a plurality of spaced spring contacts fixedly mounted in said body, each of said contacts being formed from a substantially flat sheet of metallic spring stock, each of said contacts including two opposing contact faces at the end of a single continuous length of spring, an attachment body on the other end of said spring, said attachment body being positioned within slots in said connector body, a pin on each attachment body to extend below said connector body for attachment into a mother circuitboard, first and second contact points within said socket, said contact points being spaced so that, upon entry of the edge of a printed circuitboard into said sockets at a first angle, no contact force is encountered and, upon rotation of the printed circuitboard to a second position, said contact points cut into pads on the circuitboard to ensure electric contact therewith; and said contacts being configured to be stamped and formed of sheet material with an attachment comb between a plurality of said contacts so that a plurality of said contacts can be inserted into and secured in said connector body at the same time to permit group loading of contacts into said connector body.

21. The method of making a printed circuitboard edge connector comprising the steps of:

stamping and forming from metallic sheet contact material a plurality of contacts, each serially comprising a pin, an attachment body, a spring configured to bend in the flat of the sheet material and a U-shaped socket, with the socket and spring being more narrow than the attachment body, and with the plurality of contacts being secured to a comb back to form a comb of contacts;

molding a connector body of dielectric synthetic polymer composition material to define pockets between webs with the pockets being wider then the sockets and the springs but narrower than the attachment bodies; and inserting at the same time a plurality of contacts into a corresponding plurality of pockets by passing the contacts and springs through the pockets;

engaging the attachment bodies in the webs defining the pockets to retain the contacts in the pockets so that the pins extend out of the bottom of the body; and thereafter removing the comb back so that each contact is separate.

22. The method of claim 21 wherein the step of forming the socket includes the step of forming contact points within the socket with the contact points facing each other and spaced from each other a greater distance than the thickness of a printed circuitboard inserted therebetween.

23. The method of claim 22 further including the steps:

inserting a printed circuitboard having a plurality of pads thereon into a plurality of aligned sockets which have contact points on both sides which are spaced apart a distance greater than the circuitboard thickness at an angle where the pads touch the contact points on only one side of the socket; and rotating the printed circuitboard so that the contact points on both sides of the socket engage on the printed circuitboard and resilient deflection of the contact is substantially taken up by resilient spring deflection away from the socket.

* * * * *